United States Patent [19]

Kohyama

[11] Patent Number: 4,472,046

[45] Date of Patent: Sep. 18, 1984

[54] IMAGE DENSITY DETECTING DEVICE FOR IMAGE FORMING APPARATUS

[75] Inventor: Mitsuaki Kohyama, Tokyo, Japan

[73] Assignee: Tokyo Shibaura Denki Kabushiki Kaisha, Kawasaki, Japan

[21] Appl. No.: 379,948

[22] Filed: May 19, 1982

[30] Foreign Application Priority Data

May 22, 1981 [JP] Japan ..... 56-77482

[51] Int. Cl.[3] ..... G03G 27/00

[52] U.S. Cl. ..... 355/1; 355/3 R; 355/68

[58] Field of Search ..... 355/67, 68, 69, 83, 355/35, 3 R, 38; 250/227; 362/355

[56] References Cited

U.S. PATENT DOCUMENTS 3,775,009 11/1973 Collins ..... 355/83

FOREIGN PATENT DOCUMENTS 2140519 2/1972 Fed. Rep. of Germany .
2653230 7/1976 Fed. Rep. of Germany .
2605156 8/1976 Fed. Rep. of Germany .
2837268 3/1979 Fed. Rep. of Germany .
2856741 7/1979 Fed. Rep. of Germany .
2654465 4/1981 Fed. Rep. of Germany .
3117753 2/1982 Fed. Rep. of Germany .

*Primary Examiner*—J. V. Truhe
*Assistant Examiner*—David Warren
*Attorney, Agent, or Firm*—Cushman, Darby and Cushman

[57] ABSTRACT

An image density detecting device for an image forming apparatus includes a substantially rectangular diffusing member for receiving light from document through a focusing light-transmission member and a plurality of photodiodes embedded at a suitable interval in the bottom of the light diffusing member. The longitudinal dimension of the light receiving surface mentioned above has a longitudinal dimension equal to the width of a document set on a table and a transversal dimension corresponding to an area of the document surface illuminated by an exposure lamp. Light reflected from the document illuminated by the exposure lamp is uniformalized through the light diffusing member before it is detected by the photodiodes.

4 Claims, 7 Drawing Figures

IMAGE DENSITY DETECTING DEVICE FOR IMAGE FORMING APPARATUS

BACKGROUND OF THE INVENTION

This invention relates to a device for detecting document image density for image forming apparatus, and more particularly, to a device which detects a quantity of light reflected from an original to be copied by, for example, an electronic copier, thereby detecting the image density of the original.

The quality of a copy image obtained by electronic copiers has been improved year by year. This owes to the improvement of material of a photosensitive drum or the improvement of material of toner. The improvement of a copy image also owes to mechanical improvements such as a correct adjustment of the distance between a photosensitive drum and a developing device. Further, the improved quality of a copy image is attributable to the use of an automatic exposure device which enables an electronic copier to diagnose the image density of an original. More specifically, the automatic exposure device detects the image density of an original and then controls an exposure light source, the voltage applied on the photosensitive drum or bias voltage of the developing device, in accordance with the image density detected, thereby achieving desired copying effects.

Hitherto, a photoelectric element has been used to detect the image density of an original document. The photoelectric element is so disposed below the document as to receive light reflected from the document surface. The photoelectric element can receive but light reflected from a portion of the document. It has been therefore inevitable that illumination light is controlled by the exposure control on the basis of the image density of only a portion of the document, not by the average image density of the entire document. If the photoelectric element is disposed below a central portion of the document in the width direction thereof, it receives light mostly from the central portion of the document and hardly receives light from edge portions of the document. In this case, the image density of the edge portions of the document is practically ignored in the exposure control. Therefore, proper exposure control, is difficult to accomplish. Depending upon the kind of document, particularly the size thereof, it may be impossible to obtain a copy of a desired image quality.

SUMMARY OF THE INVENTION

An object of the invention is to provide a device for detecting the image density of a document, which eliminates the aforementioned drawbacks and which can detect the average image density of the entire document surface.

To attain this object of the invention, there is provided an image density detecting device for an image forming apparatus of the type in which an image exposure is achieved by illuminating a document and guiding light reflected therefrom to a photosensitive medium, said device comprising light diffusion means having a light-receiving surface of a size corresponding to the illuminated area of the document and adapted to diffuse received light and light detecting means for detecting the intensity of light diffused by the light diffusing means.

According to the invention, light from the entire illuminated area of a document can be led in a uniformalized state to a photodetector. A proper exposure control is therefore possible, whatever size the document has.

BRIEF DESCRIPTION OF THE DRAWINGS

The above and other objects and features of the present invention will be apparent from the following description taken in connection with the accompanying drawings, in which.

DETAILED DESCRIPTION OF THE PREFERRED EMBODIMENT

Figure 1:
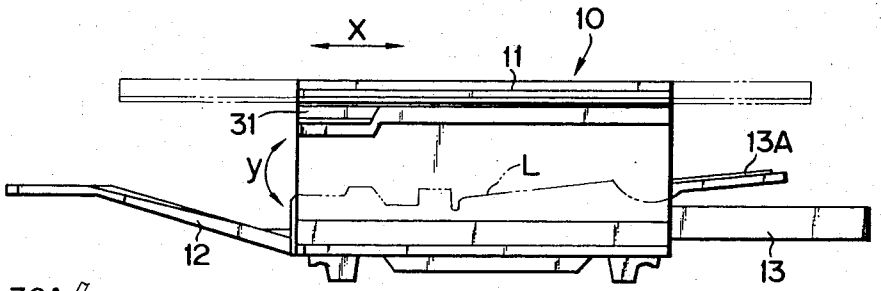
FIG. 1 is a front view showing an image forming apparatus using an image density detecting device according to the invention.
Figure 2:
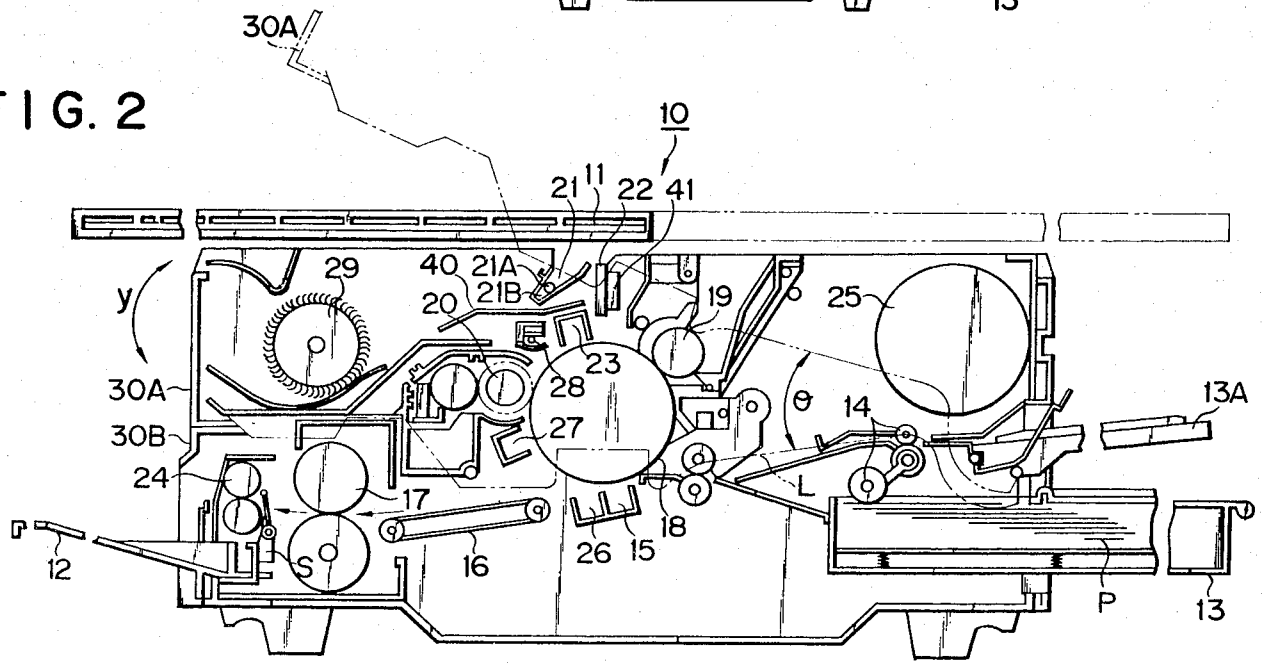
FIG. 2 is a schematic sectional view showing the image forming apparatus of FIG. 1.

FIG. 1 is a front view of a copier 10, or an image forming apparatus using an image density detection device according to the invention. FIG. 2 is an enlarged, schematic sectional view of the copier 10. As shown in FIGS. 1 and 2, the copier 10 has a table 11 which can move back and forth in the direction of arrow X. A copy sheet tray 12 is disposed in a left hand portion of the copier 10. A cassette 13 accommodating copy sheets P and a manual feed guide member 13A are provided in a right hand portion of the copier 10. Inside the copier 10 there are provided a sheet feed mechanism 14 for feeding copy sheets P from the cassette 13 or the manual feed guide 13A, an image transfer mechanism 15 for supplying a developer (hereinafter called "toner") onto a copying sheet P, a conveying mechanism 16 for conveying copy sheets P after each image transfer, a fixing mechanism 17 for fixing the toner transferred to a copy sheet P, a photosensitive drum 18 (e.g. a selenium drum), a developing device 19 for accommodating the toner, a cleaning device 20 for cleaning the photosensitive drum 18, an illuminating device 21 which includes an exposure light source lamp 21A and a reflector 21B and which illuminates a document laid on the table 11, a focusing light-transmission body 22 for transmitting light from the illuminating device 21 to the photosensitive drum 18, a light intensity detecting means 41 for detecting light reflected from the document, producing a detection output and supplying the output to an exposure intensity control system (described later in detail), a charger 23 for charging the photosensitive drum 18, conveying rollers 24 for conveying copy sheets P to the tray 12, and a motor 25 for synchronously moving table 11 and rotating the photosensitive drum 18. The copier 10 further comprises a cooling device 29 which is provided in a left hand portion for cooling heat-radiating parts. Further, a sheet absence detector (not shown), which may be a microswitch, is located above an intermediate portion of the cassette 13. A jamming detector (not shown), which may also be a microswitch, is provided on the left hand side of the fixing mechanism 17. The copier 10 further includes a sheet separator 26, a charge remover 27 and an exposure lamp 28. The housing 30 of the copier includes an upper frame 30A and a lower frame 30B. These frames are pivotally coupled to each other at one end. The frames can be opened by a predetermined angle $\theta$ (25°, for instance). The photosensitive drum 18, cleaning device 20, developing device 19 and table 11 are mounted on the upper frame 30A, thus constituting an upper unit. The cassette 13, image transfer mechanism 15, fixing device 17 and copy sheet tray 12 are mounted on the lower frame, thus constituting a lower unit. The housing 30 can be removed by turning an operating panel 31 and then opened in the direction of arrow y with reference to a path L of copy sheets P by the agency of a housing opener (not shown). Thus a jamming of sheets P occurs the path L, the sheets P can be readily removed. The image transfer mechanism 15 and sheet separator 26, both mounted on the lower frame 30B, are adapted to be electrically connected to, and disconnected to, an end portion of a high voltage generating section, for instance a high voltage transformer (not shown), provided in the upper frame 30A. They are electrically connected to the high voltage section when the upper unit is closed. They are electrically disconnected when the upper unit is opened.

With the copier having the construction as described above, a document S which is put on the table 11 is illuminated by the illuminating device 21. Light reflected from the document S is focused by the focusing light-transmission body 22 onto the periphery of the photosensitive drum 18. Subsequently, copy sheets P are fed out one after another from the cassette 13 or manual feed guide member 13A by the sheet feed mechanism 14 to a position beneath the drum 18. An image made visible with the toner by the developing device 19 is transferred onto each copying sheet P by the transfer mechanism 15. After the image transfer, the sheet separator 26 peels off the copy sheet P. The sheet P is then guided by the conveying mechanism 16 to the fixing mechanism 17. After the image fixing, the sheet P is conveyed by the conveying rollers 24 until it falls into the copying sheet tray 12. Meanwhile, after the image transfer the photosensitive drum 18 is cleaned by the charge remover 27 and cleaning device 20. A shelter plate 40 is provided to isolate the drum 18 from the illuminating device 21.

The light intensity detecting means 41 will now be described with reference to FIGS. 3 to 4.

Figure 3:
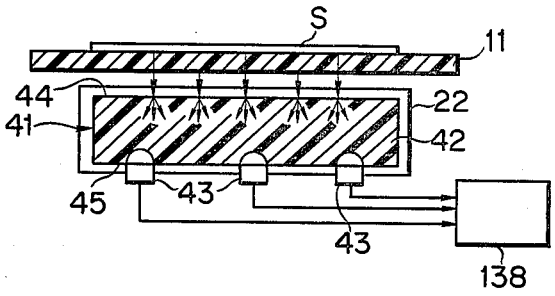
FIG. 3 is a schematic side view of the image density detecting device according to the invention.

As FIG. 3 shows, the light intensity detecting means 41 includes a light diffusion member 42 having a substantially rectangular sectional profile and a plurality of light detecting elements 43 embedded at suitable intervals in the bottom portion of the light diffusion member 42. The light diffusion member 42 may be made of a transparent resin such as acryl resin. The light detecting element may be a photodiode. The top of the light diffusion member 42 serves as a light incidence surface (or light diffusion surface). The bottom of the member 42 serves as a light emission surface. The member 42 is secured to, or suitably mounted on, a side portion of the focusing light-emission body 22. The light incidence surface 44 of the member 42 is as long as the document S is wide. The width of the surface 44 corresponds to the area of the document that is illuminated by the exposure lamp 21A: it is substantially equal to the thickness of the focusing light-transmitting body 22. Three photodiodes 43 are provided on the bottom of the light diffusion member 42. Their output are connected to a light intensity detecting circuit 138 (later described in detail). Instead, only one photodiode, or four or more photodiodes may be used.

*With this light intensity detecting means* 41, *light* reflected from the document S illuminated by the exposure lamp 21A reaches the light receiving surface 44 of the light diffusion member 42. The light is then diffused in every direction within the light diffusion member 42 and reaches the photodiodes. It is converted into an electric signal corresponding to the intensity of light. Thus, light from the entire light receiving surface is uniformalized within the light diffusion member and then detected by the photodiodes.

Figure 4:
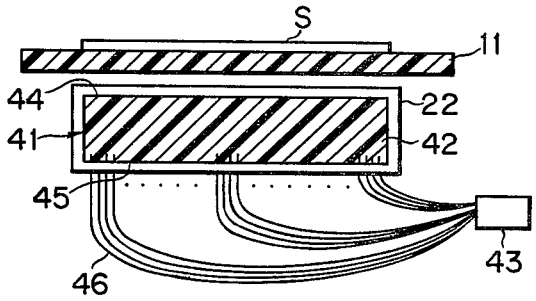
FIG. 4 is a schematic side view of another image density detecting device according to the invention.
Figure 5:
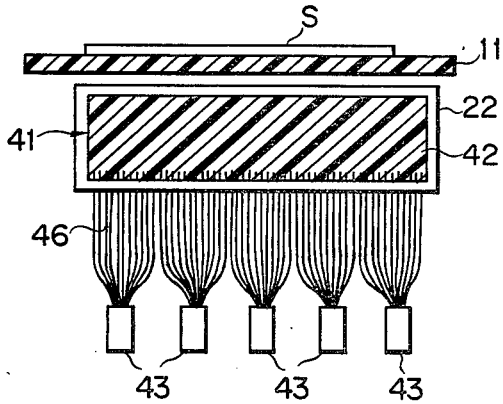
FIG. 5 is a schematic side view of a further image density detecting device according to the invention.

FIGS. 4 and 5 show two different light intensity detecting means, respectively. Either detecting means uses optical fibers 46 embedded at one end in the light emission surface 45 of the light diffusion member 42 and connected at the other end to a photodiode or photodiodes 43. All the optical fibers 46 of the detecting means of FIG. 4 are coupled to one photodiode 43. In the example of FIG. 5 the optical fibers 46 are divided into a plurality of blocks each coupled to each separate photodiode 43, thus permitting measurement of partial light flux. In other respects, the construction is the same as that of the example of FIG. 3, and the same effects can be obtained.

Figure 6:
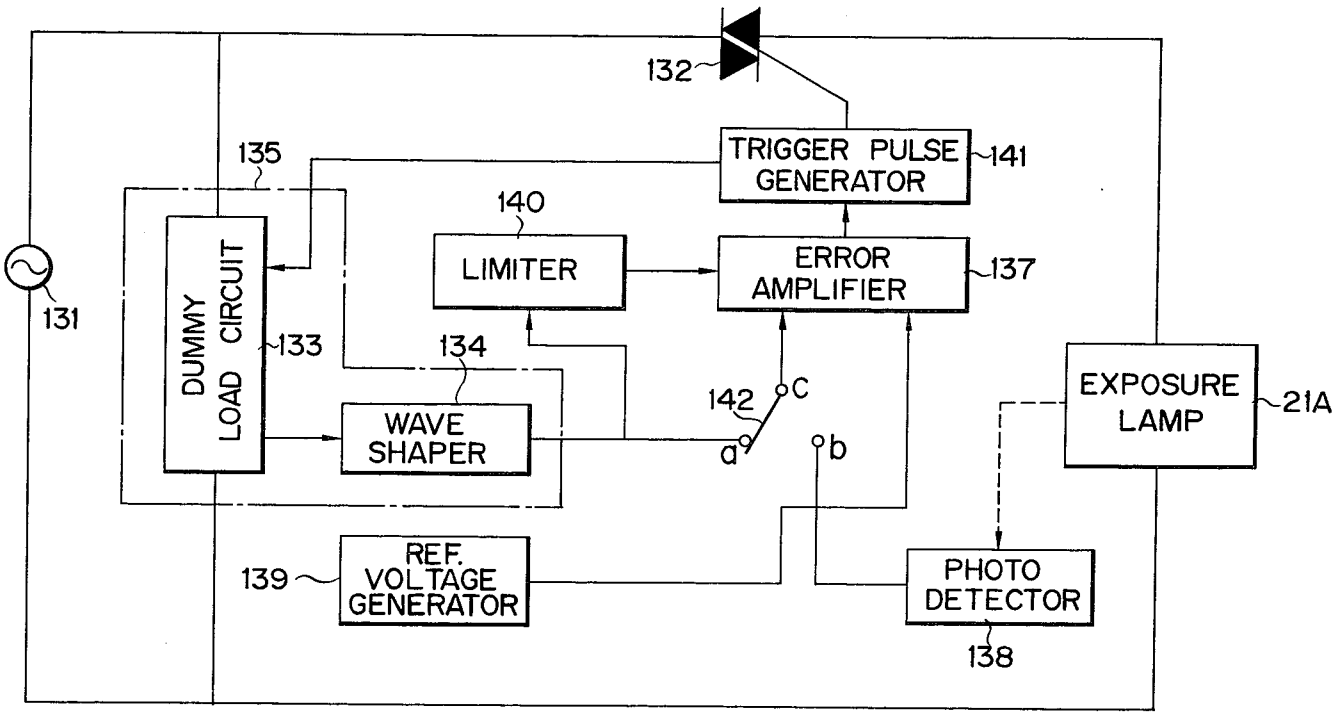
FIG. 6 is a block diagram showing an exposure control system which uses an image density detecting device according to the invention.

The output of the photodiode 43 is fed to an exposure control unit, which is schematically shown in FIG. 6. The exposure lamp 21A is connected to a commercial AC power source 131 via a bidirectional thyristor 132. A dummy load circuit 133 is connected to the AC power source 131. The circuit 133 is to apply to a dummy load a voltage corresponding to the terminal voltage applied on the exposure lamp 21A when the thyristor is triggered, and thus to provide a terminal voltage. The output voltage of the dummy load circuit 133 is applied to a wave shaper 134. The wave shaper 134 shapes the waveform of the output voltage of the dummy load circuit 133 to produce a voltage corresponding to the effective voltage of the exposure lamp 21A. The dummy load circuit 133 and wave shaper 134 constitute a voltage generating circuit 135 which generates a voltage corresponding to the voltage applied to the exposure lamp 21A.

The output voltage of the wave shaper 134 is supplied through a contact a of a selection switch 136 serving as a selection circuit to a comparator, an error amplifier 137. A photodetector 138 provides an output voltage, which is fed through a contact b of the selection switch 136 to the error amplifier 137. The error amplifier 137 compares the output voltage from the wave shaper 134 or photodetector 138 and a reference voltage provided from a reference voltage generator 139. If the two voltages differ compared, the amplifier 137 generates a signal corresponding to the difference. The photodetector 138 detects light reflected from the document and generates a voltage signal corresponding to the intensity of light detected.

A limiter 140 is connected to the error amplifier 137. When the output voltage of the wave shaper 134 exceeds a predetermined value, the limiter 140 limits the output of the error amplifier 137, so that voltage exceeding a rated value will not be applied to the lamp 12A. The output signal of the error amplifier 137 is fed to a trigger pulse generator 141. The trigger pulse generator 141 provides trigger pulses synchronized to the frequency of the power source 131. The phase of the trigger pulses is controlled according to the output signal of the error amplifier 137. The phase-controlled trigger pulses are supplied to the gate of the thyristor 132.

The operation of the circuit of FIG. 6 will now be described. Suppose the movable contacts of the selection switch 137 is connected to the contact a. If the output voltage of the wave shaper 134 differs from the reference voltage generated by the reference voltage generator 139, the output voltage of the error amplifier 137 is increased or reduced according to the magnitude of the difference, proportionally changing the phase of trigger pulse from the trigger pulse generator 141. As a result, the conduction angle of the thyristor 132 changes. This change is fed back to the error amplifier 137 in the form of trigger pulse output to the dummy load circuit 133. Thus, the output voltage of the wave shaper 134 becomes equal to the reference voltage, i.e., thereby making the voltage applied on the exposure lamp 21A constant irrespective of the voltage fluctuations in the power source 131. The limiter 140 detects the output voltage of the wave shaper 134 and limits the output of the error amplifier 137 when the output voltage thereof exceeds a predetermined value.

Suppose the movable contact of the selection switch 136 is connected to the contact b. Light from the exposure lamp 21A is reflected by the document and then caught by the photodetector 138. The photodetector 138 supplies a voltage corresponding to the light intensity of the incident light to the error amplifier 137. If it is assumed that the output voltage of the photodetector 138 is low when the light intensity of the incident light is low. If the document has a low image density less light is reflected from the document and the photodetector 138 receives a small amount of light. Consequently, the output voltage of the photodetector 138 is low. If the output voltage is lower than the reference voltage generated by the reference voltage generator 139, the error amplifier 137 amplifies the voltage difference. The difference thus amplified is fed to the trigger pulse generator 141. The trigger pulse generator 141 controls the thyristor 132, thereby increasing the conduction angle thereof. As a result, the exposure lamp 21A emits more light. This increase of light is detected by the photodetector 138. The output voltage of the photodetector 138 is compared with the reference voltage. In this way, the light dose is so controlled as to make constant the intensity of light reflected from the document. Thus, it is possible to obtain the optimum exposure intensity irrespective of the image density of the document. Further, it is possible to make control for compensating the source voltage for fluctuations, because light reflected from the document is detected.

Figure 7:
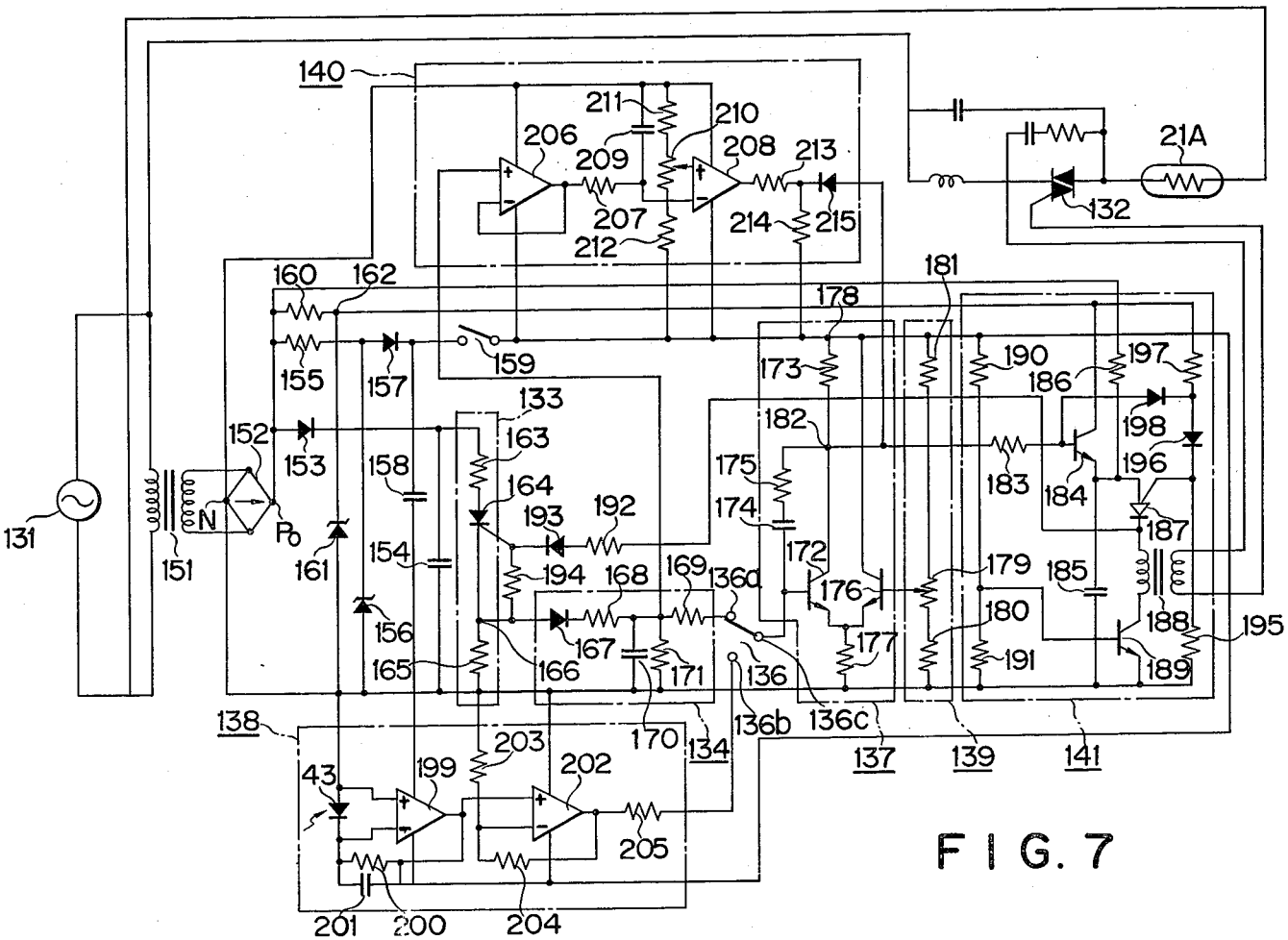
FIG. 7 is a circuit diagram showing the exposure control system of FIG. 6.

FIG. 7 shows the circuit of FIG. 6 more in detail. To the power source 131 is connected the primary winding of a power source transformer 151. The secondary winding of the transformer 151 is connected to a full-wave rectifier 152. Between DC output terminals P0 and N of the rectifier 153 there is connected a series circuit consisting of a diode 153 and a capacitor 154. Also connected between the output terminals P0 and N is a series circuit consisting of a resistor 155 and a zener diode 156. A series circuit consisting of a diode 157 and a capacitor 158 is connected in parallel to the diode 156. The junction of the diode 157 and capacitor 158 is connected to one end of a switch 159. Between the output terminals P0 and N is further connected a series circuit consisting of a resistor 160 and a zener diode 161. Trapezoidal voltage synchronized to the power source 131 appears at the junction 160 of the resistor 160 and diode 161. A resistor 163 and a unidirectional thyristor 164, these constituting the above-mentioned dummy load circuit 133, and a resistor 165 as a dummy load are connected in series forming a series circuit. This series circuit is connected in parallel to the capacitor 154. The junction 166 of the cathode of the thyristor 164 and the resistor 165 constitutes an output terminal of the dummy load circuit 133. The output terminal is connected through a diode 167 and resistors 168 and 169 in series with one another to a first fixed contact of the selection switch 136. A capacitor 170 and a resistor 171 are connected in parallel between the junction of the resistors 168 and 169 and the resistor 171. The diode 167, resistors 168, 169 and 171 and capacitor 170 constitute the wave shaper 134. The movable contact 136c of the selection switch 136 is connected to the base of an NPN transistor 172, whose collector is connected through a resistor 173 to the other end of the switch 159. A series circuit consisting of a capacitor 174 and a resistor 175 is connected between the base and collector of the transistor 172 for preventing oscillation. The emitter of the transistor 172 is connected to the emitter of another NPN transistor 176. The junction of the emitters is connected through a resistor 177 to the output terminal N. The transistor 176 has its collector connected to the junction 178 between the switch 159 and resistor 173 and its base connected to the tap of a variable resistor 179. The resistor 179 has its one end connected through a resistor 180 to the output terminal N and its other end connected through a resistor 181 to the junction 178. The transistors 172 and 176 constitute the error amplifier 137. The variable resistor 179 and resistors 180 and 181 constitute the reference voltage generator 139.

The junction 182 of the collector of the transistor 172 and the resistor 173 constitutes an output terminal of the error amplifier 137. The output terminal is connected through a resistor 183 to the base of an NPN transistor 184. The transistor 184 has its collector connected to the junction 162 and its emitter connected through a capacitor 185 to the output terminal N and also connected through a resistor 186 to the output terminal P0. The emitter of the resistor 184 is further connected to the anode of a programmable uni-junction transistor (hereinafter called "PUT") 187. The cathode of the PUT 187 is connected to the output terminal N through the primary winding of a pulse transformer 188 and an NPN transistor 189 which are connected in series. The base of the transistor 189 is connected through a resistor 190 to the junction 178 and also connected through a resistor 191 to the output terminal N. The cathode of the PUT 187 is connected also to the gate of the thyristor 164 through a resistor 192 and a diode 193 which are connected in series. This junction is connected through a resistor 194 to the junction 166. The secondary winding of the pulse transformer 188 is connected between the gate and first anode of the thyristor 132. The gate of the PUT 187 is coupled through a resistor 195 to the output terminal N and is also connected to the junction 166 through a diode 196 and a resistor 197 which are connected in series. The junction of the diode 196 and resistor 197 is connected through a diode 198 to the base of the transistor 184. The transistor 184, capacitor 185, PUT 187, pulse transformer 188, transistor 189 and diodes 196 and 198 constitute the trigger pulse generator 141.

The photodiode 43 which constitutes the light detecting element mentioned above has its anode connected to the output terminal N and also connected to a non-inverted input of an operational amplifier 199. The cathode of the photodiode 43 is connected to an inverted input of the operational amplifier 199. The cathode of the photodiode 43 is connected through a feedback amplifier 200 and a capacitor 201 also to the output terminal of the operational amplifier 199. The output terminal of the operational amplifier 199 is connected to a non-inverted input terminal of another operational amplifier 202. An inverted input terminal of the operational amplifier 202 is connected through a resistor 203 to the output terminal N and is connected through a feedback variable resistor 204 also to the output terminal of the operational amplifier 202. The output terminal of the operational amplifier 202 is connected to a second fixed contact **136*b* of the selection switch 136. The photodiode 43 and operational amplifiers 199 and 202 constitute the photodetector 138**.

The junction of the resistors 168 and 169 constitutes an output terminal of the wave shaper 134. It is connected to a non-inverted input terminal of an operational amplifier 206, which has its inverted input terminal connected to its own output terminal. The output terminal of the operational amplifier 206 is connected through a resistor 207 to an inverted input terminal of another operational amplifier 208. The junction of these terminals is connected to the output terminal N through a smoothing capacitor 209. The operational amplifier 208 has its non-inverted input terminal connected to a tap of a variable resistor 210 for setting the reference voltage. The variable resistor 210 is connected at its one end to the output terminal N through a resistor 211 and at its other end to the junction 178 through a resistor 212. The operational amplifier 208 has its output terminal connected to the junction 178 through series resistors 213 and 214. The junction of the resistors 213 and 214 is connected to the junction 182 through a diode 215. The operational amplifiers 206 and 208, variable resistor 210 and diode 215 constitute the limiter 140.

Now, the operation of the construction described above will be described. Suppose the movable contact **136*c* of the selection switch 136 is connected to the first fixed contact 136*a*. Then, the photodetector 138 is made free from exposure lamp control which will be described hereinafter. In this state, when the switch 139 is closed, a fraction voltage at the junction 178, i.e. voltage applied either resistor 190 or 191, is applied to the base of the transistor 189, thus rendering the transistor 189 conductive. At the same time, the voltage at the junction 178 is applied through the resistors 173 and 183 to the base of the transistor 184, thus rendering the transistor 184 conductive. As a result, the capacitor 185 is charged through the transistor 184. When the anode voltage on the PUT 187 exceeds the gate voltage as the capacitor 185 is charged, the PUT 187 is turned on, causing pulse current through the primary winding of the pulse transformer 188. As a result, a pulse is generated in the secondary winding of the pulse transformer 188. This pulse acts as a trigger pulse and turns on the thyristor 132, thus turning on the exposure lamp 21A. At the same time, the trigger pulse mentioned above is also applied through the resistor 192 and diode 193 to the gate of the thyristor 164, thus turning on the thyristor 164. A voltage corresponding to the voltage on the exposure lamp 21A is generated across the resistor 165. The voltage thus generated is shaped by the wave shaper 134, which is constituted by the diode 167, resistors 168, 169 and 171 and capacitor 170. Thus, a voltage corresponding to the effective voltage of the exposure lamp 21A is obtained. The voltage is applied to the base of the transistor 172 through the contacts 136*a* and 136*c* of the selection switch 136. If the base voltage on the transistor 172 is lower than the base voltage on the transistor 176, the collector voltage of the transistor 172 rises thus raising the base voltage on the transistor 184 and increasing the rate of charging of the capacitor 185. Consequently, the PUT 187 delivers pulses at an advanced timing. The conduction angle of the thyristor 132 increases, thus raising the voltage applied to the exposure lamp 21A and increasing the light intensity. The increased conduction angle of the thyristor 132 is fed back to the thyristor 164. The base voltage of the transistor 172 thus rises until it becomes equal to the base voltage of the transistor 176. Since the base voltage of the transistor 176 remains constant irrespective of voltage fluctuations of the power source 131, the base voltage of the transistor 72, i.e., the voltage applied to the exposure lamp 21A, is controlled to a constant voltage. In order to vary the voltage applied to the exposure lamp 21A, the base voltage on the transistor 176 (i.e., reference voltage) may be changed by the variable resistor 179**.

Now, suppose the movable contact **136*c* of the selection switch 136 is connected to the second fixed contact 136*b*. While light from the exposure lamp 21A is reflected by the document and led to the photosensitive drum 18, the reflected light is partly incident on the light receiving surface 44 of the light diffusion member 41. The light is then reflected by the diffusing reflection surface 45. Most of the light is incident on the photodiode 43, as mentioned earlier. Upon receipt of light, the photodiode 43 provides a corresponding light detection current which is converted by the operational amplifier 199 and resistor 200 into a voltage which is amplified by the operational amplifier 202. The output voltage of the operational amplifier 202 is applied through the contacts 136*b* and 136*c* of the selection switch 136 to the base of the transistor 172. Thus, if the document has a high image density, the intensity of the reflected light is low and a low light detection current is generated, the base voltage of the transistor 172 is therefore low. If the base voltage of the transistor 172 is lower than the base voltage of the transistor 176, the voltage applied to the exposure lamp 21A rises, thus increasing the light intensity, as described earlier. As the light intensity of the exposure lamp 21A grows, the intensity of light reflected from the document increases. The output voltage of the photodetector 138 therefore rises until it becomes equal to the base voltages of the transistors 172 and 176. In this way, the light dose of the exposure lamp 21A is automatically controlled according to the image density of the document thereby to keep constant the intensity of light incident on the photosensitive drum 18. It is thus possible always to provide for an optimum exposure intensity for various documents to ensure optimum copying. Further, stable operation source voltage can be ensured irrespective of fluctuations because the exposure intensity can be controlled by detecting changes of the light intensity of the exposure lamp 21A** due to fluctuations of the source voltage as well.

The limiter 140 operates as follows. Voltage corresponding to the voltage applied to the exposure lamp 21A is obtained at the junction of the resistors 168 and 169. This voltage is applied to the operational amplifier 208 which operates as a voltage follower. The output of the amplifier 208 is smoothed and then supplied to the operational amplifier 208, or a comparator. Thus, when the voltage applied to the exposure lamp 21A rises, the input voltage to the operational amplifier 206 also rises, thus raising the input voltage to the non-inverted input terminal of the operational amplifier 208. When the input voltage exceeds the reference voltage which is set by the variable resistor 210 and resistors 211 and 212, the operational amplifier 208 is rendered operative, and the cathode voltage on the diode 215 becomes equal to a division voltage, i.e. the voltage applied on either resistor 213 or 214. If this voltage is lower than the voltage at the junction 182 (i.e., the forward voltage drop across the diode 215), the voltage at the junction 182 (i.e., the output voltage of the error amplifier 137) is limited. In this way, the voltage applied to the exposure lamp 21A is limited and not higher than a constant voltage.

The limiter 140 having the function as described above is used for the following reason. If the exposure lamp has a rated voltage which is lower than the commercial alternating current voltage, the voltage to be applied to the exposure lamp must be not higher than the rated voltage in order to ensure long life. Further, if the document is black in a state with the movable contact 136*c* of the selection switch 136 made with the second fixed contact 136*b* or when a document cover on the document table is opened without any document on the document table, the output voltage of the photodetector 138 assumes a minimum value (near zero volt). Therefore, the limiter 140 is required where such an exposure lamp as mentioned above is used. Further, immediately after the lamp is turned on, the light intensity thereof is low so that the output voltage of the photodetector 138 is low. This, the limiter 140 is necessary in this respect as well.

As has been described, according to the invention, a voltage corresponding to the voltage applied to the exposure lamp is generated by a voltage generating circuit while light reflected from the document is detected and converted to a corresponding voltage signal by a photodetector. The intensity of light from the exposure lamp is controlled according to the result of comparison of either the output of the voltage generating circuit or the output voltage of the photodetector selectively supplied to a comparator with a preset reference voltage. It is thus possible to obtain automatic optimum exposure intensity control with respect to various documents and hence always obtain optimum copying.

The above embodiment is by no means limit the scope of the invention. Various changes and modifications are possible. For example, the exposure may be effected by moving the optical system, instead of moving a document table. In such a case, no focusing lighttransmission member such as mentioned above needs to be provided, and it is necessary to provide the document image density detection device such that it extends parallel to the optical system or permits movement of the detection device in an interlocked relation to the movement of the optical system. Further, the light source for the light intensity detection is not limited to an exposure lamp. A separate light source may be used for the light intensity detection. Further, the document image density detection device according to the invention may be employed to achieve the bias control of the photosensitive drum or the bias control of the developing device.

What is claimed is:

1. An image density detecting device for an image forming apparatus of the type in which an image exposure is achieved by illuminating a document adapted for movement along one direction with respect to said device and guiding light reflected therefrom to a photosensitive medium, comprising:

(a) light diffusion means having a light receiving surface for receiving light reflected from an area of said document changing as said document moves with respect to said device, said diffusion means being of a length in a direction transverse to said one direction coresponding to the illuminated area of the document along said transverse direction for diffusing received light; and (b) light detecting means for detecting the intensity of light diffused by said light diffusing means.

2. An image density detecting device for an image forming apparatus of the type in which an image exposed is achieved by illuminating a document adapted for movement along one direction with respect to said device and guiding light reflected therefrom to a photosensitive medium, comprising:

(a) light diffusing means having a light receiving surface for receiving light reflected from an area of said document changing as said document moves with respect to said device, said diffusion means being of a length in a direction transverse to said one direction corresponding to the illuminated area of the document and along said transverse direction for diffusing received light;

(b) optical fiber means mounted on a light emission surface of said light diffusing means; and (c) light detecting means mounted on an end portion of said optical fiber means.

3. An image density detecting device according to claim 1 or 2, wherein said light detecting means is a photodiode.

4. A device as in claim 1 wherein said light diffusing means has a substantially rectangular profile.

* * * * *